US005565124A

United States Patent [19]

Balzano

[11] Patent Number: 5,565,124

[45] Date of Patent: Oct. 15, 1996

[54] FLEXIBLE CIRCUIT HEATER

[76] Inventor: Alfiero Balzano, 11762 (O) Western Ave., Stanton, Calif. 90680

[21] Appl. No.: 331,982

[22] Filed: Dec. 19, 1994

[51] Int. Cl.[6] ..... H05B 3/16

[52] U.S. Cl. ..... 219/543; 219/528

[58] Field of Search ..... 219/528, 529, 219/543, 547–549

[56] References Cited

U.S. PATENT DOCUMENTS

| | | | |
|---|---|---|---|
| 3,417,229 | 12/1968 | Shomphe | 219/528 |
| 4,656,339 | 4/1987 | Grise | 219/543 |
| 4,788,417 | 11/1988 | Graflind | 219/528 |
| 5,226,225 | 7/1993 | Bryan | 29/825 |

OTHER PUBLICATIONS

H. C. Briel, Technical Digest No. 33, Compact Pattern of Parallel Film Resistors with Uniform Power dissipation Capability, Jan. 1974.

*Primary Examiner*—Teresa J. Walberg
*Assistant Examiner*—Sam Paik
*Attorney, Agent, or Firm*—Roger A. Marrs

[57] ABSTRACT

A flexible heater is disclosed herein having a base substrate or sheet carrying a plurality of spaced apart electrically resistive strips overlapping layers or grids of conductive strips arranged in spaced apart relationship next to each other to form a plurality of intersections with the resistive strips which, when connected, define and form an electrical resistive component of a given value. Each grid is composed of an electrical conductive material such as silver, aluminum or the like while the resistive component may be composed of carbon. The heater is employed as a hand-held unit, an insert or a portion of an article of clothing such as a boot, shoe, glove, jacket or the like. A power source is detachably provided for energizing the electrical components.

1 Claim, 3 Drawing Sheets

FLEXIBLE CIRCUIT HEATER

BACKGROUND OF THE INVENTION

1. Field of the Invention

The present invention relates to flexible heaters, and more particularly to a novel flexible heater adapted to be hand-held as a warmer or be insertably received in gloves, boots or other wearing apparel for the purpose of heating a specified area and which will readily flex during movement of the person wearing the heater so that conductive circuits will not be broken or disrupted. The heater further incorporates a plurality of resistive components composed of selective ohmic values.

2. Brief Description of the Prior Art

In the past, it has been the conventional practice to provide a variety of heaters which employ wires that are directly embedded in various portions of clothing so that the wearer of the clothing will receive the benefit of heat. This has been particularly useful in the aviation industry where wires have been run through flying clothing as well as flying boots wherein the principles of electrical resistive heating are used. However, problems and difficulties have been encountered when employing such clothing with wire conductive paths that stem largely from the fact that wires readily break when flexed so that body movements of the wearer tend to sever electrical conductive paths disrupting the circuits. In such instances, the use of the device as a heater is completely eliminated and rendered useless for its intended purpose.

Attempts have been made to overcome the above problems and difficulties by employing electrical circuit design and materials which are flexible and pliable and are not subject to structural fatigue. Such a flexible heater is disclosed in U.S. Pat. No. 4,948,951. However, conductive strips are disclosed which are made by means of a substrative method through a chemical etching process which removes material and which are of a fixed resistance with no means for resistive adjustment. The prior structures are not suitable for being layered which is an additive construction and provides a selective means for adjusting or establishing desired values of resistance.

Therefore, a need has existed to provide a flexible unitary structure of conductive strips arranged in an overlapping relationship so that selective intersection may be joined to establish resistances of desired values. In this manner, a flexible heater is envisioned which creates a uniform heater that may be "screened on" to an insulative substrate or base layer in an "additive" or layered construction rather than in a "substractive" construction such as chemical etching.

SUMMARY OF THE INVENTION

Accordingly, the problems and difficulties encountered with conventional flexible heaters are avoided by the present invention which provides a flexible unitary structure having flexible insulative material serving as a substrate or base layer for supporting at least two layers of electrically conductive strips arranged so that the conductive strips of one layer are spaced from and insulated from the conductive strips of a second layer wherein the two conductive layers carry electrical energy of opposite polarity respectively. Electrical components such as resistors are formed by adding a plurality of resistive strips over and normal to the two conductive layers of strips whereby a plurality of intersections are provided. A discrete resistive component is created by joining selective intersections to provide a pair of spaced apart junctions defining the electrical resistive component therebetween.

Preferably, the electrical energy conductive strips are composed of electrically conductive particles in a cohesive ink form. The resistive component is in a cohesive ink form having a specific resistance or electrical characteristic when cured. The strips of electrical energy conductive materials may be of silver composition while the other resistive component strips may be composed of carbon so that the length of carbon strip between junctions constitutes a resistor wherein the width, length and thickness determines component value.

The conductive strips may be arranged in a pattern on pillows, cushions or wearing apparel substantially covering or outlining the body portion intended to be heated and substantially following the contour of the pillow, cushion or wearing apparel. Suitable power source means is operatively coupled to the energy conductive circuits of opposite polarity for providing electrical resistance heating via the resistive components and the power source may be selected from a variety of energy sources such as rechargeable batteries, storage cells, piezoelectric crystals or the like.

Therefore, it is among the primary objects of the present invention to provide a novel heater construction incorporating flexible electrical circuits having a base or substrate or insulative material preformed with a plurality of electrically conductive strips carried thereon so that the heater is flexible in its operative electrical conducting condition without being subjected to breakage and disruption of the electrical circuit.

Yet another object of the present invention is to provide a relatively inexpensive and easy-to-use heater composed of a unitary construction of flexible material and conductive strips in the form of a flexible circuit created by adding layers of conductive materials of different compositions on top of one another.

Yet another object of the present invention is to provide a novel heater composed of flexible circuitry as a unitary construction that may be readily inserted into wearing apparel of a user so that total environmental control is gained over temperature and moisture conditions within the article of apparel.

Yet another object of the present invention resides in providing a flexible heater having a pair of electrically conductive grids overlapped and joined at preselected spaced intervals to define discrete electrical components such as a plurality of resistors of selective resistive values.

A further object resides in providing a flexible heating circuit having a multiplicity of heating areas or points of heat by "screened on" electrical conductive strips in an "additive" manner.

BRIEF DESCRIPTION OF THE DRAWINGS

The features of the present invention which are believed to be novel are set forth with paticularity in the appended claims. The present invention, both as to its organization and manner of operation, together with further objects and advantages thereof, may best be understood with reference to the following description taken in connection with the accompanying drawings in which:

DESCRIPTION OF THE PREFERRED EMBODIMENT

Figure 1:
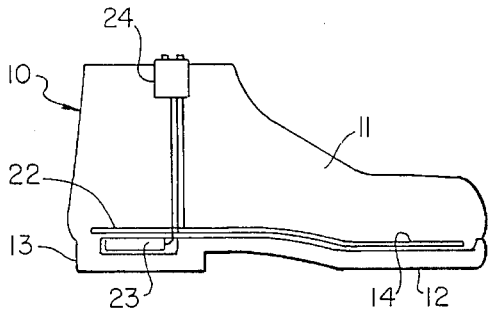
FIG. 1 is a diagrammatic view showing a boot having the novel flex circuit heater of the present invention inserted therein with a battery power source.

Referring to FIG. 1, a boot is indicated by numeral 10 which includes a boot top 11 and a sole 12 which terminates in one end at a toe and at its opposite end with a heel 13. The flexible circuit heater of the present invention is indicated in general by numeral 14 and includes a length of insulative material carrying a plurality of spaced-apart electrical conductive strips so that a thin coating, film or layer of plastic material retains the conductive strips in position whereby the flex or flexible circuit is unitary in construction. The flex or flexible circuit or cable comprises a plurality of parallel and spaced-apart electrical conductors, such as indicated by numerals 15, 16 and 18 illustrated in FIG. 2 which are carried beneath coatings or sheets of plastic constituting insulation. The insulation separates adjacent conductors and holds the respective conductors in position with respect to one another as a unitized element or article. As will be described later, the conductors comprise a pair of energy-conducting elements or bus strips which are connected to a battery supply while other conductors are of resistive material so as to create heat when the circuit is complete.

Figure 2:
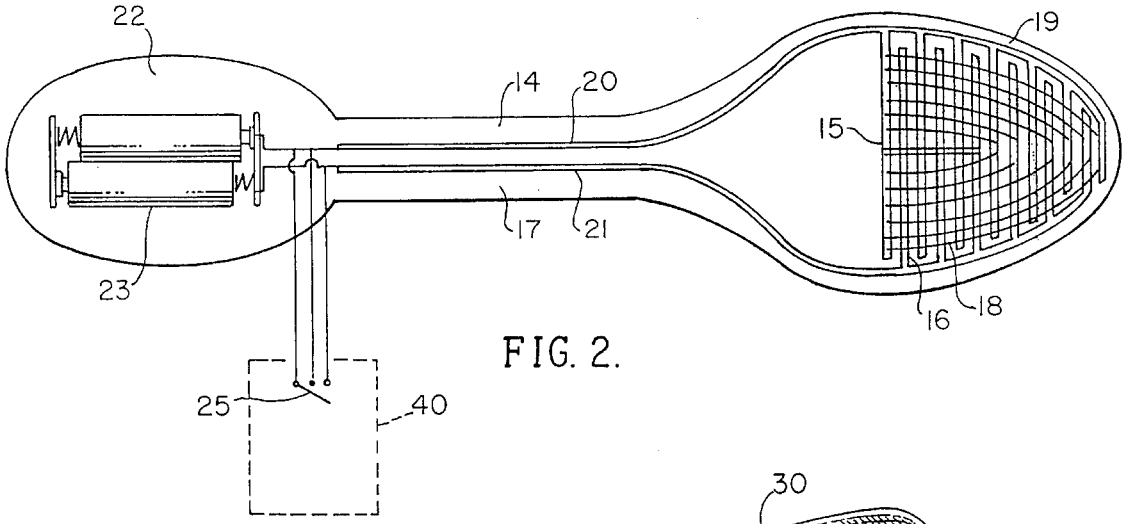
FIG. 2 is an enlarged plan view of the novel flex circuit heater as employed in the boot shown in FIG. 1.

Referring specifically to FIG. 2, the electrical conductors of the flex circuit heater 14 constitute power carrying bus lines along the mid-section or central part 17 of the circuit heater and terminates at one end constituting a toe area 19. It is to be borne in mind that the circuit heater 14 is substantially flat and is of thin or narrow thickness and that each of the conductor strips is flat and is of substantially reduced thickness as compared to the diameter of conventional wire heaters. Furthermore, because of the construction, the flexible circuit heater may be considered a laminant or of sandwich construction and because of the thinness, the circuit heater is very flexible and may be bent over upon itself without breaking or causing undesirable material fatigue in the conductors while being used in a folded position.

The heel portion of the flexible circuit heater is indicated by numeral 22 and extends into the heel as shown in FIG. 1. Power for the flexible circuit heater is supplied by batteries 23 that may be incorporated into heel 13 of the boot, or, if desired, a battery pack 24 may be detachably carried along the edge of the boot top with electrical conductors extending into connection with the bus lines 20 and 21. In many instances, the power source may be carried on the flexible circuit heater 14 itself, as suggested by FIG. 2, and an on/off switch 25 may be included.

Figure 3:
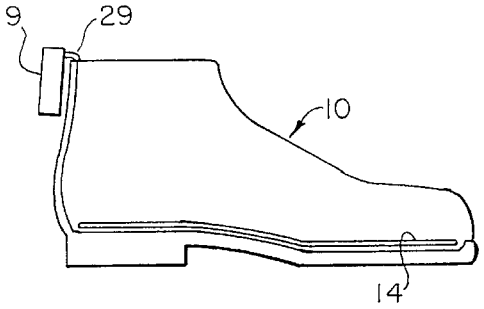
FIG. 3 is a view similar to the view of FIG. 1 illustrating the flex heater incorporated into a boot with a rechargeable power unit.

Referring to FIG. 3, the boot 10 is provided with an external battery pack 9 that is detachably carried about the edge of the boot by means of a clip 29. Therefore, it is to be understood that the flexible heater circuit of the present invention is a separate unit that is integral with respect to its power supply and heating elements so that the flexible circuit heater may be insertably disposed into the interior of the boot so as to lie on the upper surface of the sole 12. Because the heater is composed of a flexible circuit having thin conductive strips, normal movement and stress of the user's foot as it is used during walking or running will not cause weakening of the conductive strips as would be the case if conventional wires were used. The conductive strips are narrow and thin in cross section so that the flexing and bending movements are readily absorbed without stress buildup.

Figure 4:
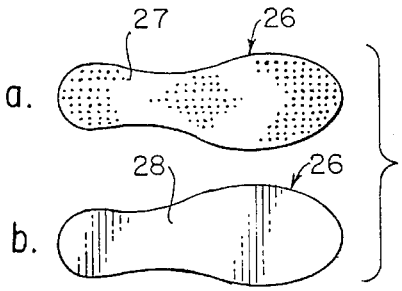
FIG. 4 illustrates an innersole or insert for use with footwear or other garments and which employs the novel flex circuit heater.

Referring now to FIG. 4, the inventive concept of of the present invention envisions that the flexible circuit heater 14 may be used in combination with an innersole for a shoe or boot. As illustrated in FIG. 4, FIG. 4*a* shows a pad 26 having a top surface with a plurality of perforations 27 for the purpose of allowing cross-ventilation for moisture absorbtion and moisture transfer. However, the underside of the innersole 26 presents a continuous surface 28 which is unperforated. The perforated layer 27 and the unperforated layer 28 are bonded respectively to opposite sides of flexible the circuit heater 14.

Figure 5:
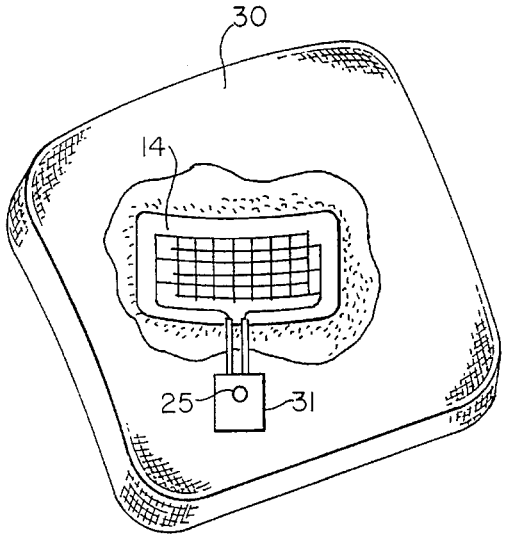
FIG. 5 is a perspective view of a pillow or cushion partially broken away to expose placement of the novel flex heater therein.

Another application for the novel circuit heater of the present invention is illustrated in FIG. 5 wherein a cushion is illustrated having a flexible circuit heater 14 carried internally and connected to a suitable power source 31 actuated by the switch 25. Therefore, the cushion may be heated to a suitable temperature by means of energizing the circuit heater so that a therapeutic warmth is provided to the user.

Figure 6:
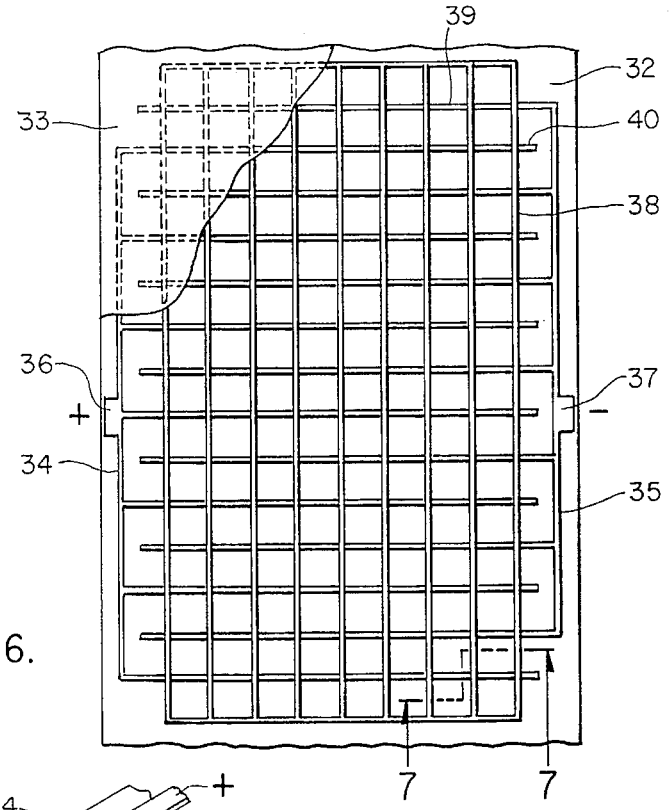
FIG. 6 is an enlarged diagrammatic plan view of a flex circuit heater illustrating the pattern of powered conductive strips crossed over by strips of resistive composition.

Referring now in detail to FIG. 6, a greatly enlarged diagrammatic illustration is provided showing the conductive strips arranged in an electrical circuit operable to provide heat while being flexed. An underlayer or coating is indicated by numeral 32 which supports the electric circuit and the circuit is covered by a similar insulative layer 33. The layer or coating 33 is broken away to expose the circuit which comprises energy conducting elements or conductors 34 and 35 which are equal to the conductors 20 and 21 shown in FIG. 2. The conductor 34 is coupled to a positive power supply source indicated by numeral 36 while conductor 35 is connected to a negative side of the power supply as indicated by numeral 37. It is to be particularly noted that the conductors 34 and 35 are arranged in a pattern so as to provide a wide area over which the heating process is inteded to take place. In such an arrangement, the conductors are separated from one another so there is no shorting and the insulative material of coatings or layers 32 and 33 maintain the conductors in the desired pattern. For purposes of explanation, the conductors are arranged substantially in parallel relationship with respect to one another and are equally spaced apart. The connection of the conductors with the positive and negative poles or terminals of the power supply run along the outside of the circuit having the plurality of parallel conductive elements running towards one another across the face of layers 32 and 33. It is to be understood that the conductors or the conductive elements 34 and 35 carry energy power since they are directly connected to the power source. In a sense, these are bus lines and carry power; however, they are insulated from one another and are only connected together by a plurality of electrically conductive resistor strips or conductors such as indicated by numeral 38. Therefore, when comparing FIGS. 2 and 6 together, it can be seen that the conductive elements 34 and 35 are the same as the conductive elements 20 and 21 while the spaced-apart and parallel arranged energy conducting strips 15 and 16 are identical to the strips 39 and 40. The conductive resistive strip 18 is equal to the strip 38. Therefore, the principle of operation is that when power is supplied along the bus strips 34 and 35, the power is available to the conductive strips 39 and 40 so that at each intersection of the strips 39 and 40 with the conductive strip 38, an intersection is provided which will cause current to be drawn through the resistor strip and therefore generate heat. No shorting will occur since the resistive strips are of ohmic value permitting current to flow and not to short.

Figure 8:
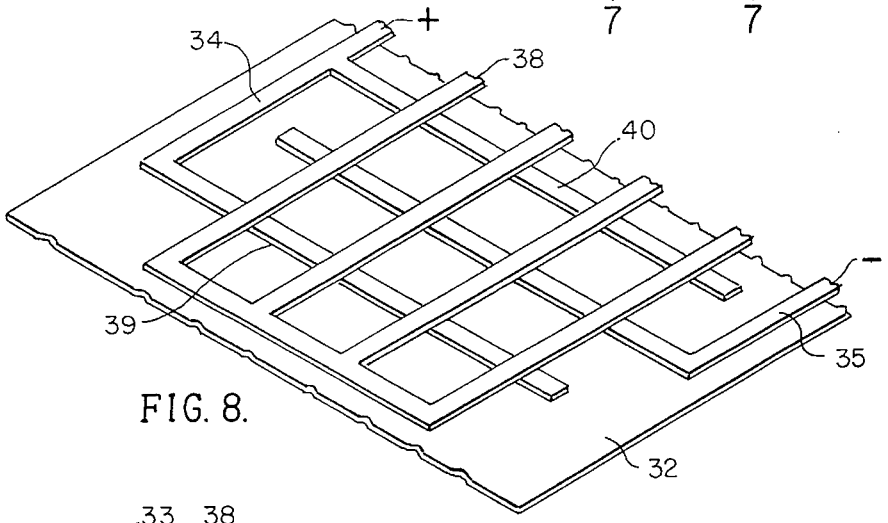
FIG. 8 is a fragmentary view, in perspective, of the flex circuit heater shown in FIG. 6.
Figure 7:
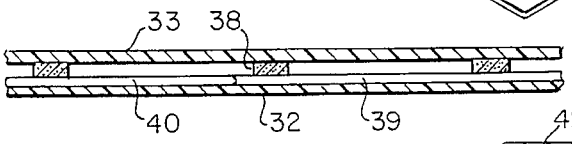
FIG. 7 is a greatly enlarged fragmentary cross-section of the flex circuit heater shown in FIG. 6 as taken in the direction of arrows 7—7 thereof.

Referring now in detail to FIGS. 7 and 8, the circuit construction shown in FIG. 6 is illustrated wherein it can be seen that the energy or power carrying conductive strips for both negative and positive polarity are carried on the substrate 32 in spaced-apart relationship and that the resistive conductive strips 38 are carried on top of the two energy carrying conductive strips represented by numerals 39 and 40. A typical intersection of the conductive strip with the power carrying conductors is shown in FIG. 7 and such an intersection permits current to pass into the conductive strip where heat is generated depending upon the ohmic value between the intersections.

The power carrying conductive strips 34 and 35 as well as the transverse conductive strips 39 and 40 are preferably composed of a silver epoxy ink suitable for conducting electrical energy and such an ink is manufactured and sold by Du Pont under part number 5007. Such an ink is used to fabricate low-voltage circuitry, especially on flexible substrates such as substrate 32. As an alternate, part number 5007 may be used when faster drying conditions are required or when design considerations dictate a higher operating use temperature. Manufacturers literature describes the silver conductive ink as a polymer thick film composition. The silver epoxy ink forming the conductor maybe placed on the substrate using conventional screen printing equipment which represents an additive process rather than a subtractive one as earlier described. The insulative material 32 and 33 may be a polyester material and separates the various conductors from each other. With regard to the resistive conductive strip 38, a carbon ink may be used which is manufactured by Du Pont under the part number 7101 as an example. When the above materials are cured, adhesion takes place with the respective insulation layers 32 and 33. Curing or thermally setting may be employed depending on the substrate material which can cure either thermally or chemically treated to increase bonding. If thermal curing is used, time is varied in order to eliminate material shrinkage. Thermal curing removes any solvent or moisture and thermally setting within a temperature range of 200–300 degrees produces a memory in the polyester so that upon twisting or folding , the unit will have a tendency to return to an original state.

Figure 9:
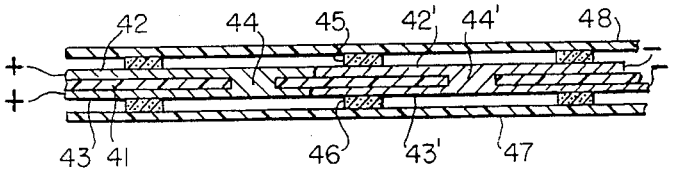
FIG. 9 is a fragmentary cross-section view of a flex circuit heater incorporating multiple circuit layers.

Referring now in detail to FIG. 9, another embodiment of the present invention is illustrated wherein more than one circuit is provided. The embodiment shown in FIG. 9 includes a central insulation layer 41 having a conductive layer arranged on each side and subsequently connected to a positive source of power. The layers on opposite sides of the insulative material 41 are identified by numerals 42 and 43 with a feed through connecting link identified by numeral 44. Therefore, the layers 42 and 43 obtain power form the same supply and may be considered as a single conductor. Over the tops of the layers 42 and 43, there is disposed a plurality of resistive conductive strips such as identified by numeral 45 and 46 which are identical to those conductive strips described above. In this fashion, a resistive circuit is included on both sides of the central power strip 42. The negative power source is illustrated by numerals 42 prime and 43 prime with an interconnecting link 44 prime. Therefore it can be seen that the circuit of FIG. 9 discloses two separate circuits carried on the central base and the circuits are separate from one another. The commonality for the energy or power supply is via the interconnecting links 44 and 44 prime.

Figure 10:
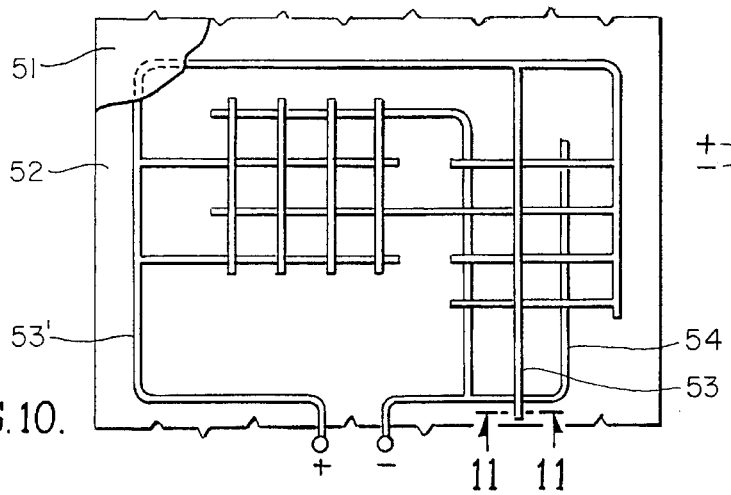
FIGS. 10 and 11 are another version of the invention illustrating insulative material interposed between cross-over areas of powered conductive strips.
Figure 11:
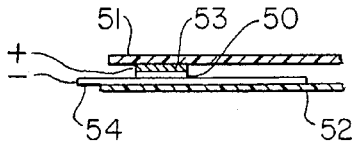

Referring now in detail to FIG. 10, two circuits are illustrated; however, one circuit is insulated from the other through the use of a curable dielectric which is identified by numeral 50 in FIG. 11. Substrates composed of insulative material are represented by numerals 51 and 52 while the power conductor connected to positive polarity source is identified by numeral 53. The power conductor connected to the negative power source polarity is identified by numeral 54. Therefore, it can be seen that additional circuits can be provided which are insulated from one another by using the curable dielectric material 50. Such material is used only where the positive and negative crossover in lateral spaced-apart inks are employed. The dialectric ink may be cured by either employing UV treatment or IR treatment. When utilizing UV color-sensitive materials, curing is achieved by utilizing the UV light. However, heat is employed when employing the IR ink. Such a curable dialectric is manufactured and sold by Du Pont under part number 5018 which is an example of a UV curable dialectric. Such composiiton is polymetric dialectric which is a UV curable, solventless, screenprintable composition used in encapsulant and crossover applications for both rigid and flexible circuit manufacture. It offers the advantages of rapid cure and excellent processing latitude while maintaining excellent electrical and physical properties after cure, including excellent crosshatch adhesion to print-treated and good adhesion to non-print-treated substrate and conductor materials.

In view of the foregoing, it can be seen that the heat generated over the many intersection points created by the crossover of the carbon strips with the silver conductor power strips creates a uniform heater to warm a cold foot, hand, neck, integrated circuit or cushion at a lower cost than prior heaters. Lower cost occurs because the heater of the present invention can be "screened on" in an "additive" process. The width and thickness of the carbon emulsion sets the value of resistance for the resistive strips. The carbon curable ink layer in the respective embodiments sets up the point of resistance at the points where it intersects with the positive and the negative silver ink conductor layer. Multilayers can be employed for more than one circuit with interconnections being made through the "feed-through" holes in the insulation which are then occupied or coded with the conductive silver ink. Thus, the links of silver ink in the holes interconnect both sides when applied or screened on.

Figure 12:
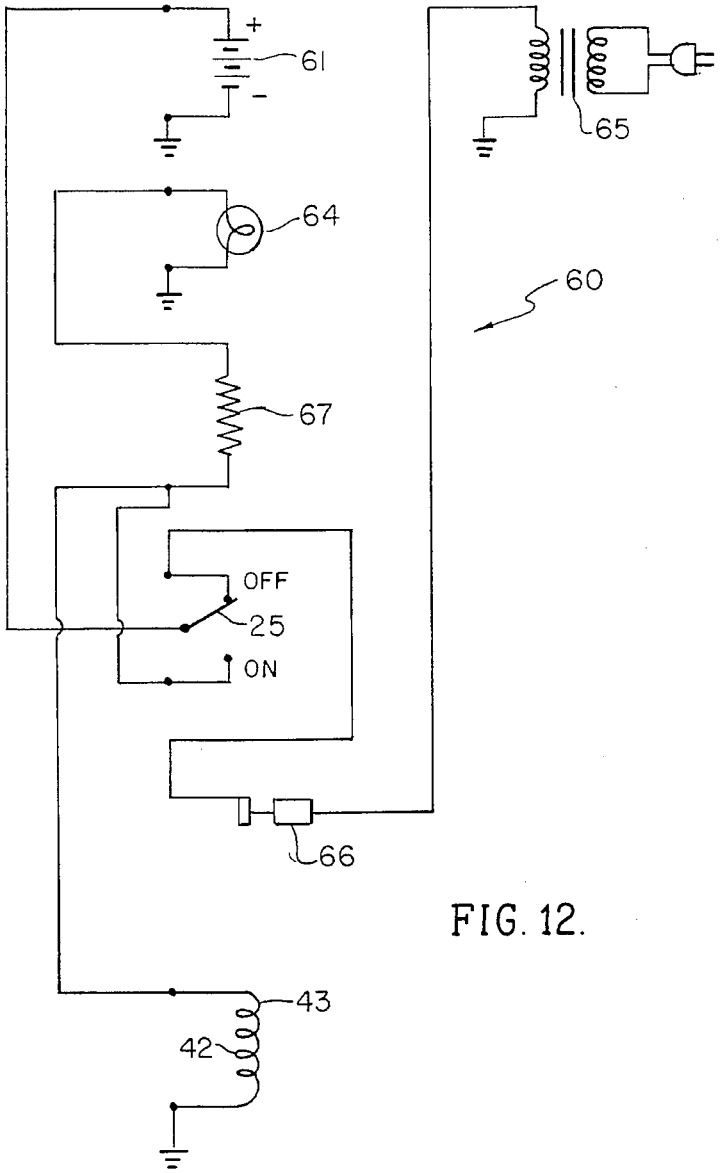
FIG. 12 is a circuit diagram illustrating an operable electrical circuit for supplying power to the heater of the present invention.

Referring now in detail to FIG. 12, the circuit 60 is more clearly illustrated, having a power source 61 adapted to be applied to a coil 62 for drawing heater current. The resistance of the coil can be selectively altered by removing a slight portion of the material forming a part of the coil resistance. For example, a plurality of thickened material layers, such as conductive layer 43 may be selectively removed so as to alter the resistance of the entire coil to a desired amount. A light 64 indicates that the operation is on and that the heating circuit is complete. The on/off switch 25, when in the off position, represents a charging circuit when a rechargeable transformer 65 is connected to the circuit by means of a jack 66. The switch 25 is a manual switch operable by the user. A load resistor 67 is employed for drawing current.

While particular embodiments of the present invention have been shown and described, it will be obvious to those skilled in the art that changes and modificaitons may be made without departing from this invention in its broader aspects and, therefore, the aim in the appended claims is to cover all such changes and modificaitons as fall within the true spirit and scope of this invention.

What is claimed is:

1. A flexible circuit heater for use as a warmer comprising:

an elongated, flat, flexible substrate of an electrically insulating material;

a first pattern of electrically conductive power carrying strips deposited and carried on said substrate;

a second pattern of electrically conductive power carrying strips deposited and carried on said substrate adjacent to and in spaced-apart relationship with respect to said first pattern of electrically conductive power carrying strips;

a plurality of electrically resistive conductive strips arranged in a third pattern defining an integral interconnecting grid across and in electrical and mechanical contact with the strips of said first and said second patterns to establish a plurality of contact intersections;

said resistive conductive strips arranged in horizontal and vertical relationship to define said grid and wherein selective lengths of said resistive conductive strips extend between spaced ones of said contact intersections constituting a fixed resistor of specific ohmic value;

said specific ohmic value of said fixed resistor being determined by a specific length, thickness and width of said resistive conductive strip;

said first and said second patterns include electrically conductive power carrying strips defined as bus lines with a plurality of transverse power lines laterally carried on said substrate;

said transverse power lines of each of said first and said second patterns being in alternate spaced-apart relationship separating said resistive conductive strips from said substrate;

said electrically conductive power carrying strips are composed of a low current carrying silver material incorporating a curable bonding agent adhering to said substrate;

said resistive conductive strips are composed of a carbon material having a curable bonding agent adhering to said first and said second patterns and to said substrate; and a flexible cover layer of insulative material bonded over said first, said second and said third patterns and joined with said substrate.

* * * * *